US012690633B2

(12) United States Patent
Vaughn et al.

(10) Patent No.: US 12,690,633 B2
(45) Date of Patent: Jul. 28, 2026

(54) TEMPERATURE REGULATING INSULATIVE SYSTEM

(71) Applicant: Marmot Mountain, LLC, Rohnert Park, CA (US)

(72) Inventors: Aubrey Vaughn, Sebastopol, CA (US); Tran Quang Hao, Hanoi (VN)

(73) Assignee: Marmot Mountain, LLC, Rohnert Park, CA (US)

( * ) Notice: Subject to any disclaimer, the term of this patent is extended or adjusted under 35 U.S.C. 154(b) by 45 days.

(21) Appl. No.: 18/564,295

(22) PCT Filed: May 27, 2022

(86) PCT No.: PCT/US2022/072608

§ 371 (c)(1),
(2) Date: Nov. 27, 2023

(87) PCT Pub. No.: WO2022/251870

PCT Pub. Date: Dec. 1, 2022

(65) Prior Publication Data

US 2024/0260695 A1 Aug. 8, 2024

Related U.S. Application Data

(60) Provisional application No. 63/194,526, filed on May 28, 2021.

(51) Int. Cl.
*A41D 31/06* (2019.01)

(52) U.S. Cl.
CPC ..... *A41D 31/065* (2019.02); *A41D 2400/10* (2013.01)

(58) Field of Classification Search
CPC .... A41D 31/065; A41D 2400/10; A41D 3/00; A41D 13/02; A41D 13/0058; A41D 13/0153; A41D 13/0158
See application file for complete search history.

(56) References Cited

U.S. PATENT DOCUMENTS 2,561,872 A * 7/1951 Krinick ..... A41D 13/065 2/24
3,950,789 A * 4/1976 Konz ..... F25D 3/14 2/81

(Continued)

FOREIGN PATENT DOCUMENTS

| | | | |
|---|---|---|---|
| EP | 1447017 | B1 | 10/2008 |
| KR | 200446466 | Y1 | 10/2009 |
| WO | 2020092873 | A1 | 5/2020 |

*Primary Examiner* — Alissa L Hoey
(74) *Attorney, Agent, or Firm* — Husch Blackwell LLP

(57) ABSTRACT

A cell pattern is provided that may be arranged on an interior portion of a garment or other outdoor equipment. The cell pattern may help keep a garment wearer warm while also improving the breathability of the garment. The cell pattern may comprise warming cells that may take on a variety of shapes, sizes, and patterns, but the cells are preferably square-shaped and arranged in rows a "running-bond" or offset brick-like pattern. Rows of cells may be attached to a shell material, with each of row of insulated cells separated from one another by non-insulated channels. Each cell within a row is preferably attached to the shell on two of its opposite sides such that air flows over and under the cells to improve temperature regulation around the wearer's body.

20 Claims, 6 Drawing Sheets

(56) References Cited

U.S. PATENT DOCUMENTS

| | | | | |
|---|---|---|---|---|
| 4,690,847 | A * | 9/1987 | Lassiter | B32B 5/24 428/175 |
| 5,150,476 | A | 9/1992 | Statham et al. | |
| 5,515,543 | A * | 5/1996 | Gioello | A41D 31/102 2/DIG. 1 |
| 6,668,385 | B2 * | 12/2003 | Gathings, Jr. | A41D 27/04 2/97 |
| 8,876,875 | B1 * | 11/2014 | Nilforushan | A61H 1/008 607/108 |
| 10,111,480 | B2 * | 10/2018 | Pezzimenti | A41D 31/065 |
| 10,512,291 | B2 * | 12/2019 | Reuben | A41D 31/065 |
| 10,849,374 | B2 * | 12/2020 | Clarke | A41D 31/065 |
| 10,966,477 | B2 * | 4/2021 | Baker | A41D 27/24 |
| 11,019,865 | B2 * | 6/2021 | Pezzimenti | A41D 27/02 |
| 11,230,087 | B2 * | 1/2022 | Matsumoto | B32B 15/08 |
| 11,279,109 | B2 * | 3/2022 | Ly | B32B 5/022 |
| 11,457,682 | B2 * | 10/2022 | Massey | A41D 31/102 |
| 11,723,424 | B2 * | 8/2023 | Skurla, III | D06J 1/00 2/243.1 |
| D1,009,455 | S * | 1/2024 | Vaughn | D5/60 |
| 12,011,054 | B2 * | 6/2024 | Jordaan | B32B 5/26 |
| 12,389,964 | B2 * | 8/2025 | Ridley | B32B 5/14 |
| 2013/0298589 | A1 | 11/2013 | Holdsworth-Layton | |
| 2015/0000004 | A1 * | 1/2015 | Silverberg | A41D 13/1209 2/69 |
| 2015/0118438 | A1 * | 4/2015 | Yui | B32B 27/12 428/101 |
| 2015/0290901 | A1 * | 10/2015 | Banowit | B32B 7/05 5/413 R |
| 2018/0338563 | A1 * | 11/2018 | Moretti Polegato | A43B 7/06 |
| 2019/0223526 | A1 * | 7/2019 | Knodt | A41D 1/04 |
| 2020/0009828 | A1 * | 1/2020 | Ly | B32B 5/26 |
| 2021/0392980 | A1 * | 12/2021 | Vaughn | A41D 31/06 |
| 2022/0369743 | A1 * | 11/2022 | Cizek | A41D 31/06 |
| 2024/0049823 | A1 * | 2/2024 | Ridley | A41D 31/06 |

* cited by examiner

TEMPERATURE REGULATING INSULATIVE SYSTEM

CROSS-REFERENCE TO RELATED APPLICATIONS

This application is a U.S. National Phase Application of International Application No. PCT/US2022/072608 filed on May 27, 2022, which claims priority to U.S. Provisional Patent Application Ser. No. 63/194,526, filed on May 28, 2021, entitled "Temperature Regulating Insulative System,", the entire disclosure of both applications are incorporated herein by reference.

FIELD OF INVENTION

The present invention relates generally to garments and/or other outdoor equipment, and more particularly to an insulative system that may be used to improve temperature regulation of garments and/or other outdoor equipment without sacrificing breathability of the garments and/or outdoor equipment.

BACKGROUND OF THE INVENTION

Outdoor enthusiasts enjoy hiking, skiing, snowshoeing, and undertaking similar aerobic activities in low temperature environments, including environments with freezing and/or subzero temperatures. Because the air temperatures may be cold during aerobic activities, outdoor enthusiasts typically wear outdoor gear to help them stay warm, including gear that is made with, for example, down insulation or synthetic insulation. Such insulation can affect the warmth, weight, water resistance, compressibility, and retail price of garments.

In garments, down insulation and/or synthetic insulation is often quilted in a grid-like fashion where different "pockets" of the insulation material are sewn apart from one another while also being positioned and located adjacent to one another. Alternatively, in garments that are made in the "puffer-style," elongated sections or baffles of quilted insulation material are sewn adjacent to one another. This design is often provided on both the interior and exterior of a garment. For example, one or both the interior and exterior of a jacket may be of the "puffer-style."

Standard insulated garments, such as those with grid-like quilted designs or the "puffer design" described above, may keep a wearer warm but fail to adequately regulate the wearer's temperature during high aerobic activities in cold environments. The standard insulated garments are poor temperature regulators because they lack air flow within the garment and are not breathable. Some garment manufacturers attempt to achieve temperature regulation with traditional quilting applications. However, this solution is not optimal because it reduces the garment's loft and thus its thermal capacity, which in turn impacts how warm the garment can keep the wearer.

SUMMARY OF THE INVENTION

The current invention is a temperature regulating insulative system designed to keep a wearer comfortable before, during, and after high aerobic activities in cold environments. More particularly, the insulative system keeps a wearer warm but provides breathability.

The insulative system may comprise rows of insulated cells that may be attached to a fabric layer or a shell material.

Each row of insulated cells may be separated from one another by channels that either contain no insulation or less insulation than the cells. Each cell within a row is preferably attached to the shell via a first set of opposing sides while remaining unattached to the shell on a second set of opposing sides. Attaching the cells to the shell in this manner may allow air to flow over and/or under the cells to help improve temperature regulation around the wearer's body. Thus, the resulting insulative system helps keep the wearer warm when in cold temperatures and helps prevent the wearer from overheating during high aerobic activities.

DETAILED DESCRIPTION OF THE INVENTION

Figure 1:
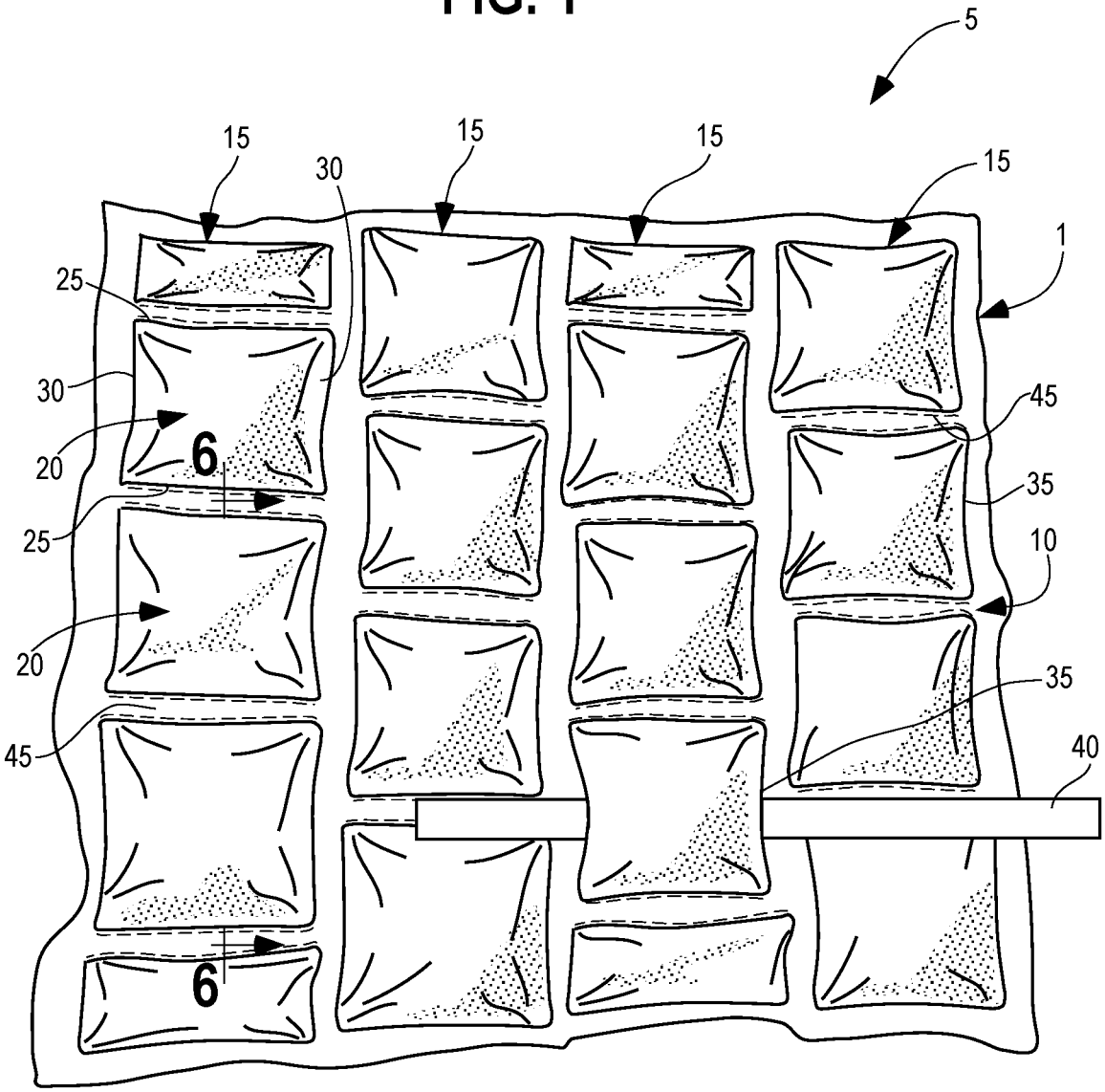
FIG. 1 is a first perspective view of a temperature regulating insulative system constructed according to the teachings hereof.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The invention is directed towards a temperature regulating insulative system that may be incorporated into a garment. The insulative system may help a wearer maintain a comfortable body temperature in a variety of thermal environments, including low-temperature environments. The fabric of the insulative system may comprise, by way of nonlimiting example, cotton, nylon, polyester, spandex, or combinations thereof, and the insulative material retained within the insulative system may comprise, by way of nonlimiting example, synthetic fiber, down, open-cell foam, and the like. Furthermore, the insulative system may be incorporated into a variety of garments including, but not limited to, pants, gloves, sweaters, jackets, overalls, and body suits.

Referring to the drawings, FIG. 1 illustrates a fabric layer or a shell material 1 of a garment (not illustrated) with a temperature regulating insulative system 5 attached thereto. The shell material 1 may comprise, by way of nonlimiting example, cotton, nylon, polyester, spandex, or combinations thereof. The shell material 1 may be used to create a garment, or the shell material 1 may be coupled to a body fabric of the garment. In a preferred embodiment, the insulative system 5 is attached to an interior 10 of the shell material 1 such that the insulative system abuts a wearer when the garment including the shell material 1 is worn. In alternative embodiments, the insulative system 5 could be attached to the exterior (not illustrated) of the shell material 1 in addition to or in place of the interior 10.

As provided in the embodiment illustrated in FIG. 1, the insulative system 5 is made up of rows 15 of rectangular and square shaped cells 20. Specifically, the cells 20 include first opposite sides (or first sides) 25 and second opposite sides (or second sides) 30 that may be equal in length. Because the cells 20 are illustrated as square-shaped, the first opposite sides 25 are perpendicular to the second opposite sides 30. In alternative embodiments, the cells 20 may be provided as other shapes and the relationships between the sides 25, 30 may be different than as previously described. For example, each of the cells 20 making up a cell pattern may be provided as a polygon having substantially the same size and substantially the same shape. As an additional example, each cell of the cells 20 making up a cell pattern may be provided as a polygon having the same size and the same shape. In FIG. 1, the cells 20 have sides 25, 30 that measure approximately four inches, but in alternative embodiments, the sides 25, 30 may be a limitless number of different lengths depending on the application for which the pattern of cells 20 is being used. While the depth of individual cells 20 is not explicitly illustrated, the cells 20 may be at a height from about a quarter inch to three inches, and they are preferably the same height within a single product. In other embodiments, the cells 20 at certain positions in the product may be provided in different sizes, shapes, heights, etc., as compared to the cells 20 in other positions in the product. Each of the cells 20 are preferably stuffed with goose or duck down, a featherless material, synthetic material, an open-celled foam, or any combination thereof. The cells 20 are preferably constructed of a material that is substantially down- and/or fiber-proof, meaning neither down nor synthetic fibers may leak through the fabric.

Figure 2:
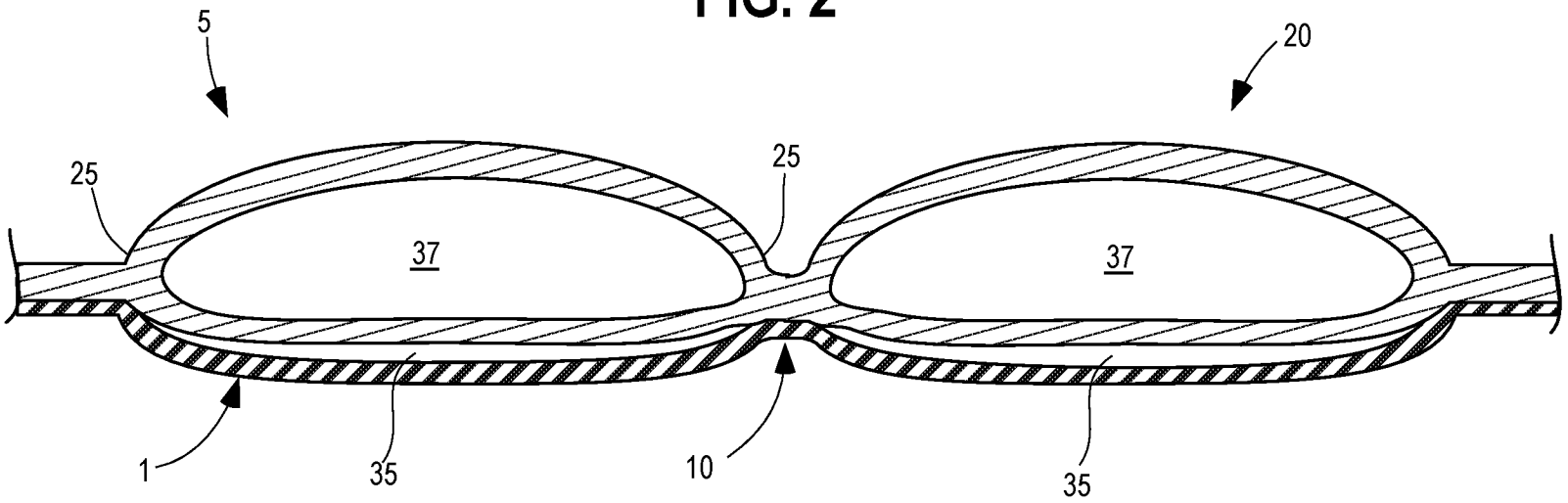
FIG. 2 is a cross-sectional view of the insulative system of FIG. 1 taken along the line 6-6.

As illustrated, the first sides 25 of the cells 20 are attached to the shell material 1, but the second sides 30 are not. In some embodiments, the second sides 30 may be attached to the shell material 1 rather than the first sides 25. When only one of the sides 25, 30 is attached to the shell 1, a passthrough 35 is defined between the cells 20 and the interior 10 of the shell material 1, as illustrated in FIGS. 1 and 2. In effect, the sides 25 or 30 that are not attached to the shell material may provide an aperture via which air can enter and exit the passthrough 35, which itself may be an opening, a channel, a passage, or a similar structure through which air may flow. In addition, an underside of each cell of the cells 20 forming a cell pattern may be positioned above the passthrough 35 associated with the particular cell (see, e.g., FIG. 3). Thus, when the passthrough 35 is provided, air may flow over the cells 20 and/or between the cells 20 and the shell material 1. By providing multiple routes via which air can flow around and through the insulative system 5, the insulative system 5 may improve temperature regulation around the wearer's body. In addition, because the insulative material (not illustrated) may be retained within a volume 37 of the cells 20, the insulative system 5 may also help keep the wearer warm in low-temperature environments.

In FIG. 1, an elongated object 40 is shown to be threaded through the passthrough 35 in order to more clearly illustrate the passthrough 35. Such elongated object 40 is not a part of insulative system 5 or the shell 1 and is merely for illustrative purposes.

Figure 3:
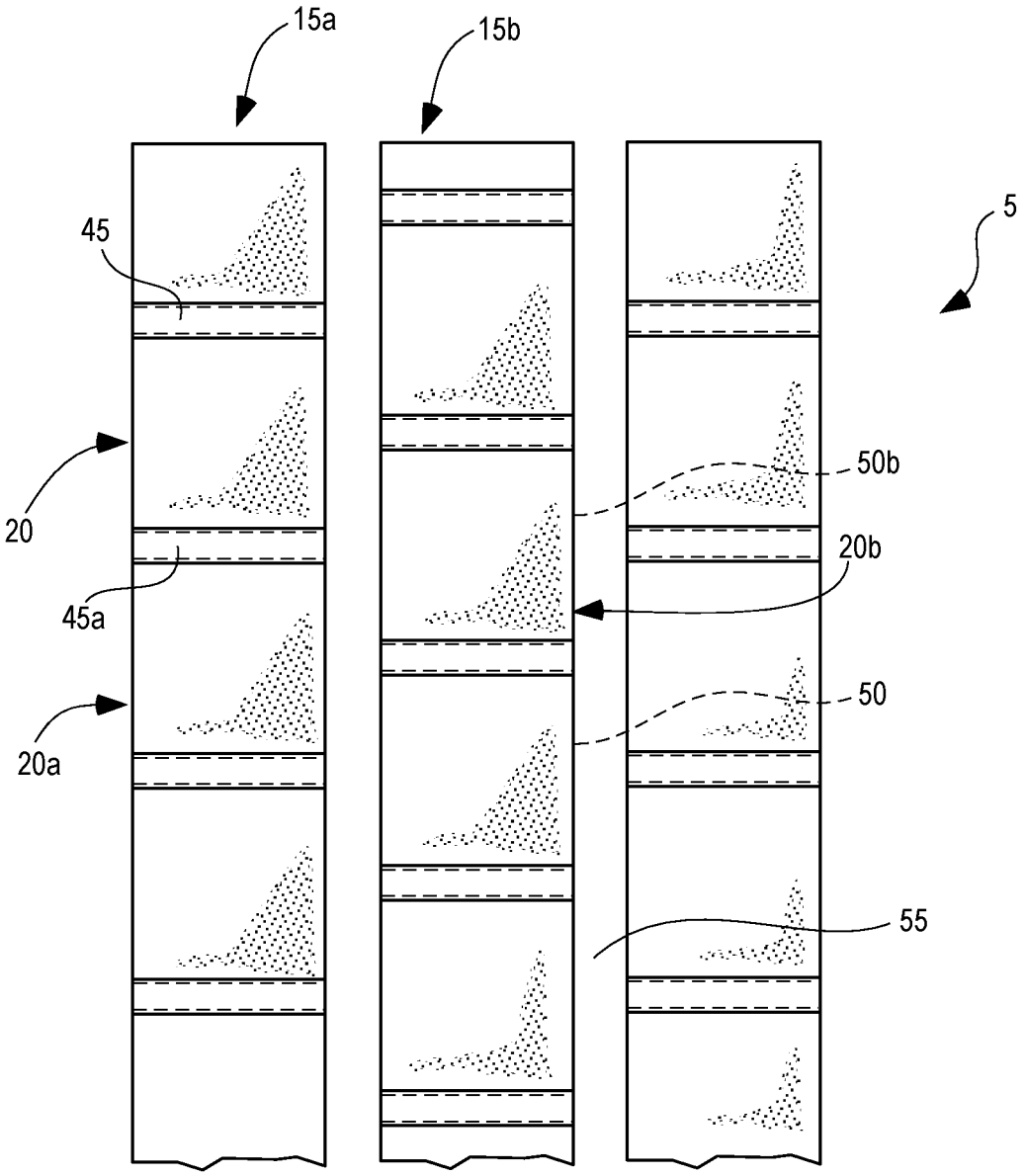
FIG. 3 is a plan view of the temperature regulating insulative system illustrated in FIG. 1.
Figure 4:
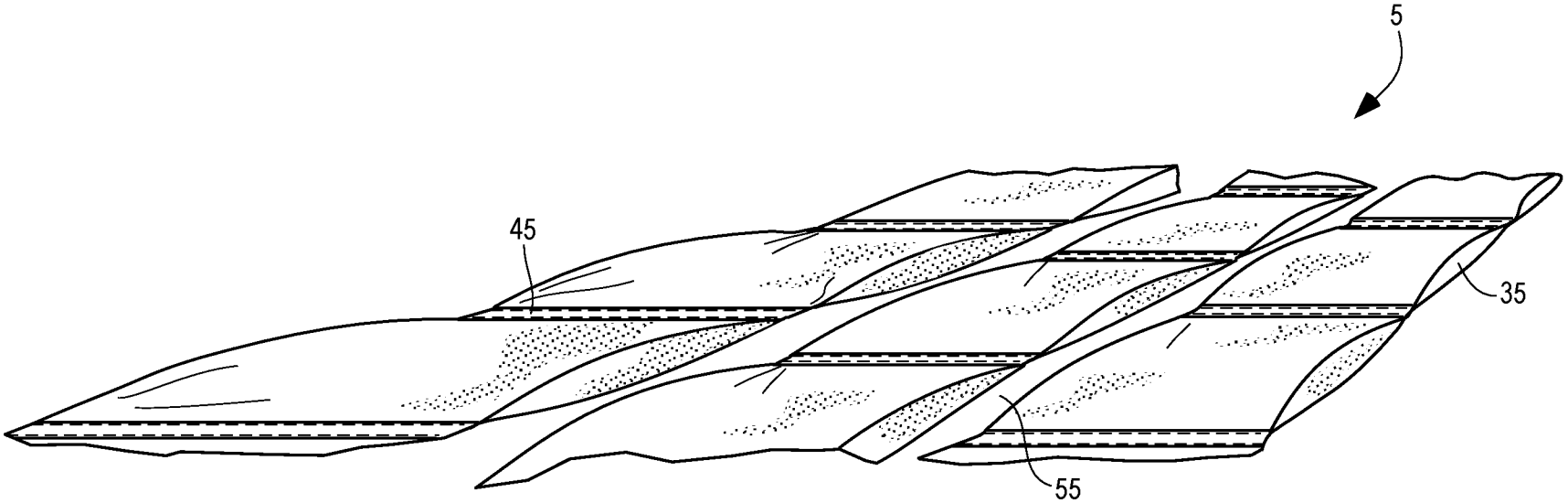
FIG. 4 is a second perspective view of the temperature regulating insulative system illustrated in FIGS. 1-3.

Each row 15 of the cells 20 may be attached to the shell 1 at its first sides 25 at a seam 45, as further illustrated in FIGS. 3 and 4. The seam 45 is preferably formed by sewing the cells 20 to the shell 1, though other foreseeable or known attachment methods (e.g., bonding) are also envisioned herein. More particularly, the seam 45 may comprise a single stitch or a double stitch. A double stitch is illustrated in the embodiment provided in FIG. 3, and a gap is present between the stitches. The gap may or may not include insulative material.

As best illustrated in FIG. 3, the cells 20 may be arranged in a "running bond" brick-like pattern. For a given row in the "running bond" pattern, the seams 45 substantially align with a middle 50 of a given cell 20 on a row adjacent to the given row. For example, in row 15*a*, the seam 45*a* of cell 20*a* aligns with the middle 50*b* of a cell 20*b* of a row 15*b* adjacent to the row 15*a*. Nevertheless, other arrangements of the rows 15 are foreseeable.

Between adjacent rows 15, channels 55 may be formed. The channels 55 are preferably non-insulated. In a preferred embodiment, the channels 55 are between a quarter inch and two inches wide, but in alternative embodiments, the channels 55 may be wider or somewhat narrower. Moreover, while the cells 20 are illustrated in FIGS. 3 and 4 in the "running bond" pattern, in alternative embodiments the cells 20 may be arranged in a different pattern, which in turn would impact the positioning of the channels 55.

While a square shape for the cells 20 is preferable, other cell shapes may be used. Such shapes include, but are not limited to, rectangles, triangles, diamonds, irregular polygons, regular polygons, and the like. In some embodiments, including the embodiment illustrated in FIGS. 1-4, a combination of differently shaped cells 20 may be provided. In alternative embodiments, only one shape of the cells 20 may be provided in the insulative system 5.

Figure 5:
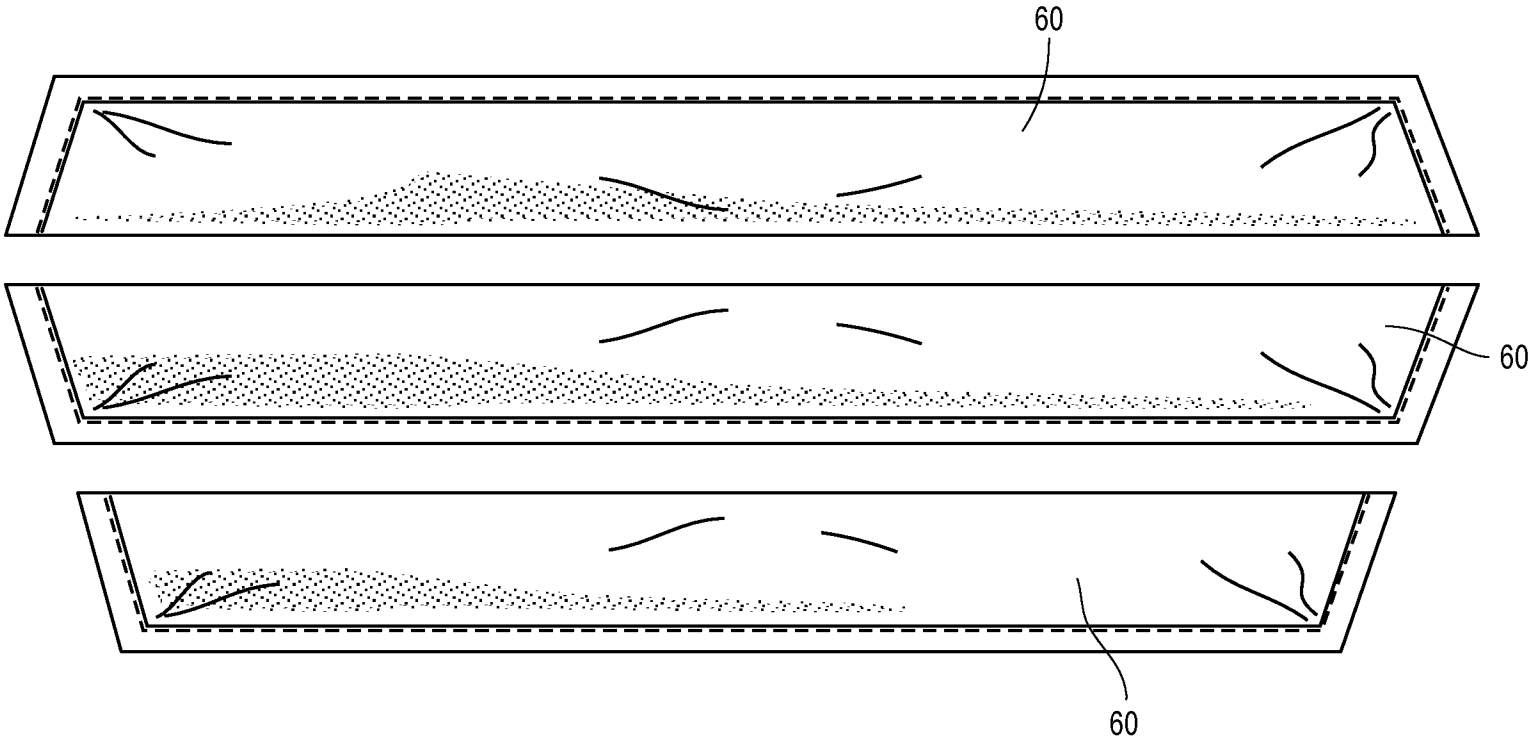
FIG. 5 is a plan view of a tube that, when stitched, forms the cells of the temperature regulating insulative system of FIGS. 1-4.
Figure 6:
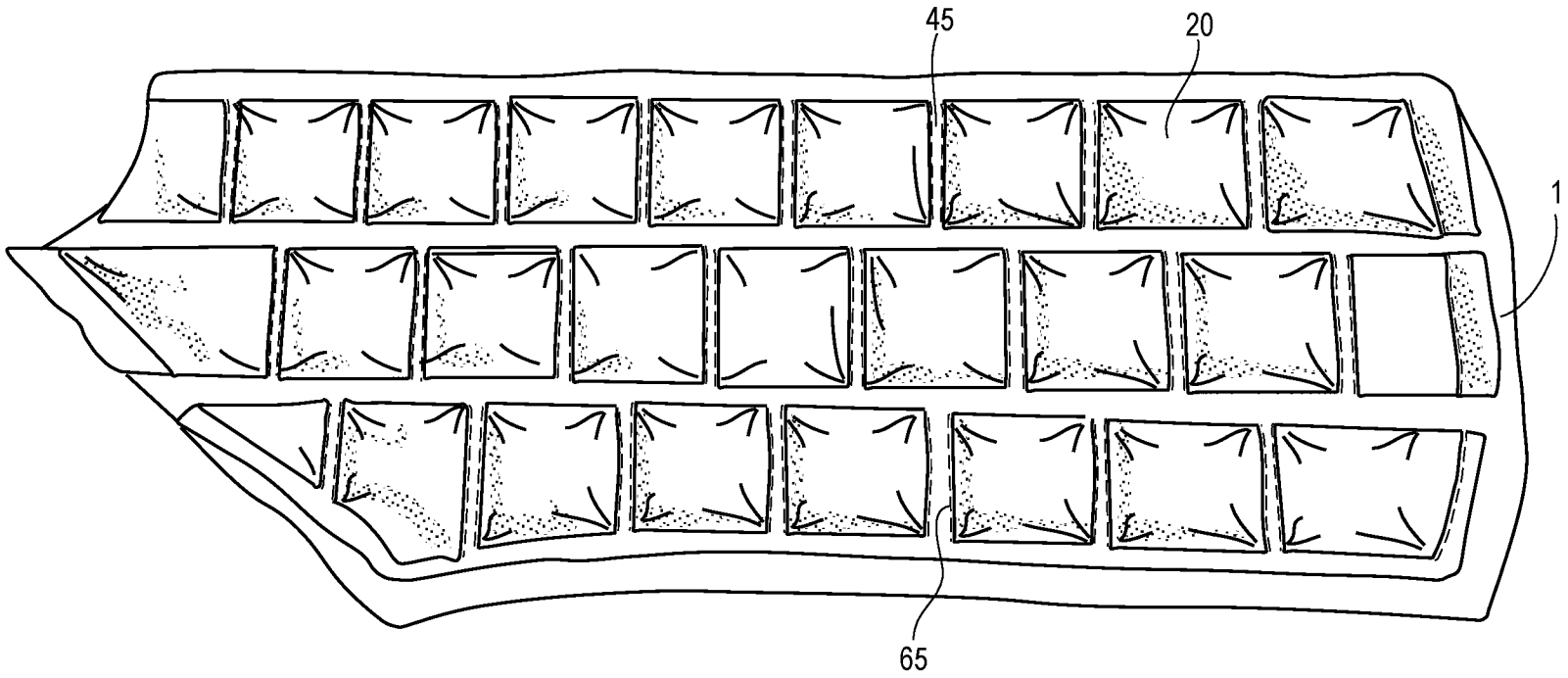
FIG. 6 is a plan view of the tube of FIG. 4 after stitching the tubes to a shell material.

FIGS. 5 and 6 together illustrate a method or process that may be used to construct the insulative system 5. In FIG. 5, tubes 60 are provided which may be positioned and arranged to create the above-described rows 15. More particularly, the tubes 60 may be formed from elongated sections of insulated material contained within a covering. When constructing the insulative system 5, the tubes 60 may be placed over the shell 1 and then attached to the shell 1 with stitching 65 to form the insulative system 5, as provided in FIG. 6. The pattern of the stitching 65 may be adapted such that when the cells 20 are formed, the cells 20 may be provided in a variety of shapes and sizes. Further, as previously described, the cells 20 may be attached to the shell 1 in a variety of manners, including bonding.

From the foregoing, it will be seen that the various embodiments of the present invention are well adapted to attain all the objectives and advantages hereinabove set forth together with still other advantages which are obvious and which are inherent to the present structures. It will be understood that certain features and sub-combinations of the present embodiments are of utility and may be employed without reference to other features and sub-combinations. Since many possible embodiments of the present invention may be made without departing from the spirit and scope of the present invention, it is also to be understood that all disclosures herein set forth or illustrated in the accompanying drawings are to be interpreted as illustrative only and not limiting. The various constructions described above and illustrated in the drawings are presented by way of example only and are not intended to limit the concepts, principles and scope of the present invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required."

Many changes, modifications, variations and other uses and applications of the present constructions will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The invention claimed is:

1. A cell pattern for a garment, the cell pattern comprising:

a shell;

a plurality of cells attached to the shell, the plurality of cells arranged in a plurality of rows including a first row, a second row, and a third row, wherein a first non-insulated channel is positioned and located between the first row and the second row, and a second non-insulated channel is provided between the second row and the third row; and a plurality of passthroughs, the plurality of passthroughs provided as openings between the plurality of cells and the shell, wherein an underside of each cell of the plurality of cells is positioned above a passthrough of the plurality of passthroughs, wherein seams are provided between adjacent cells in each row of the plurality of rows, and the seams extend perpendicularly from the first non-insulated channel and to the second non-insulated channel, wherein the plurality of cells provided in the plurality of rows are arranged in a running bond pattern.

2. The cell pattern of claim 1, wherein opposing first sides of the plurality of cells are attached to the shell and opposing second sides of the plurality of cells are not attached to the shell.

3. The cell pattern of claim 1, wherein at least a portion of the plurality of cells are provided as squares.

4. The cell pattern of claim 1, wherein the plurality of cells include opposing first sides and opposing second sides;

the opposing first sides are coupled to the shell via the seams;

the seams are provided in the form of double-stitch seams, where a gap is positioned and located between stitches of the double-stitch seams; and passthrough openings are positioned and located between the opposing second sides of the cell.

5. The cell pattern of claim 1, wherein an insulative material is provided within a volume of each cell of the plurality of cells.

6. The cell pattern of claim 1, wherein the plurality of cells comprise a substantially down-proof and substantially fiber-proof fabric.

7. An insulative system for a garment, the insulative system comprising:

a fabric layer;

a plurality of cells attached to the fabric layer, the plurality of cells positioned and located such that they define rows, wherein each cell of the plurality of cells includes an interior volume that retains an insulative material; and wherein the plurality of cells are adapted to allow air to flow through passthroughs positioned and located between the fabric layer and the plurality of cells, wherein the plurality of cells are further arranged in a running bond pattern in which non-insulated channels are provided between adjacent rows of the plurality of cells in the running bond pattern, whereby the non-insulated channels are arranged parallel to the rows of the plurality of cells.

8. The insulative system of claim 7, wherein each cell of the plurality of cells are provided as a polygon with at least three sides.

9. The insulative system of claim 7, wherein at least one side of each cell of the plurality of cells is attached to the fabric layer.

10. The insulative system of claim 7, wherein at least two sides of each cell of the plurality of cells are not attached to the fabric layer such that the at least two sides define openings for a passthrough.

11. The insulative system of claim 10, wherein the passthrough is positioned and located between the fabric layer and each cell of the plurality of cells.

12. The insulative system of claim 7, wherein the fabric layer comprises a body fabric of the garment; or the fabric layer is coupled to the garment.

13. The insulative system of claim 7, wherein each cell of the plurality of cells is provided as a polygon of the same size and the same shape.

14. A temperature regulating system for a garment, the system comprising:

a plurality of cells provided in at least one predetermined shape, wherein each cell of the plurality of cells is stuffed with an insulating material; and a shell material, where the plurality of cells are coupled to the shell material via double-stitched seams;

wherein at least two sides of each cell of the plurality of cells are coupled to the shell material such that an air passage is provided between the shell and an underside of each cell of the plurality of cells, wherein an arrangement of the plurality of cells is defined by rows of cells and non-insulated channels, where the non-insulated channels are positioned and located between the rows of cells, and the rows of cells and non-insulated channels are parallel to each other, wherein the double-stitched seams define gaps that are positioned and located between adjacent cells in a given row of cells, wherein the non-insulated channels are perpendicular to the gaps.

15. The system of claim 14, wherein an insulative material is retained within the plurality of cells.

16. The system of claim 14, wherein the at least one predetermined shape comprises polygons.

17. The system of claim 14, wherein openings for the air passage are provided by sides of the plurality of cells that are not coupled to the shell material.

18. The system of claim 14, wherein the at least two sides of each cell of the plurality of cells includes a first set of opposing sides and a second set of opposing sides, the second set of opposing sides defining openings for the air passage.

19. The system of claim 14, wherein the gaps are not insulated, the channels are between 0.25 inches and 2 inches wide, and the rows of cells are arranged in an offset pattern.

20. The system of claim 14, wherein each cell of the plurality of cells are provided in the same predetermined shape.

* * * * *